United States Patent [19]

Nelson

[11] Patent Number: 4,965,542

[45] Date of Patent: Oct. 23, 1990

[54] MAGNETIC SWITCH FOR COAXIAL TRANSMISSION LINES

[76] Inventor: Victor Nelson, 8 Midvale Ct., East Northport, N.Y. 11731

[21] Appl. No.: 316,659

[22] Filed: Feb. 28, 1989

[51] Int. Cl.[5] ..... H01H 53/00

[52] U.S. Cl. ..... 335/5; 333/105; 200/504

[58] Field of Search ..... 335/4, 5; 333/105; 200/504

[56] References Cited

U.S. PATENT DOCUMENTS

| | | | |
|---|---|---|---|
| 3,487,342 | 12/1969 | Gibson et al. | 335/5 |
| 3,544,933 | 12/1968 | Gregory et al. | 335/179 |
| 4,496,919 | 1/1985 | Fournier et al. | 335/5 |
| 4,795,994 | 1/1989 | Hoffman | 335/179 |

*Primary Examiner*—Leo P. Picard
*Assistant Examiner*—Lincoln Donovan
*Attorney, Agent, or Firm*—Edward H. Loveman

[57] ABSTRACT

This invention concerns a magnetic switch assembly used for switching input and output signals between coaxial transmission lines connected to a body having a closed cavity in which terminals of the lines are exposed. One or more conductive contact members, which are the only moving parts in the cavity, bridge one or more pairs of line terminals in closed circuit portion. The contact members are moved magnetically from open to closed position, and are latched or held failsafe by stationary permanent magnets or pulsed electromagnets. The contact members are moved to open position by pulsed electromagnets or rotatable permanent magnets. The contact members comprise magnetized strips, magnetic strips, or nonmagnetic strips carrying magnets or magnetic members. The assembly can be arranged for single or multiple pole, single or multiple throw switching.

19 Claims, 5 Drawing Sheets

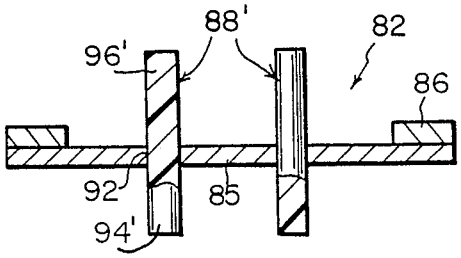
FIG. 7
FIG. 8
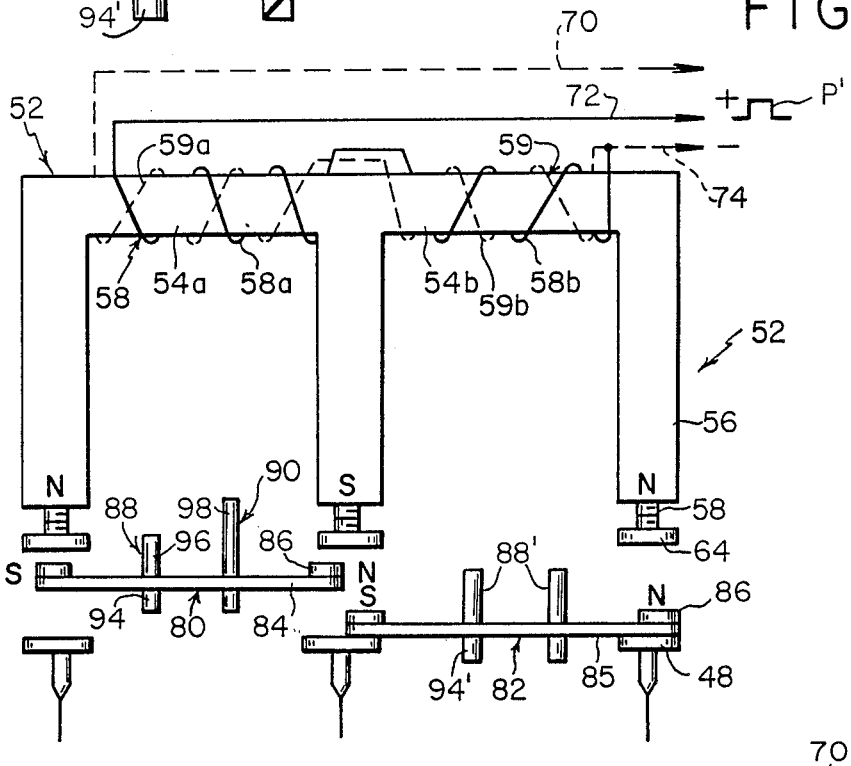
FIG. 9
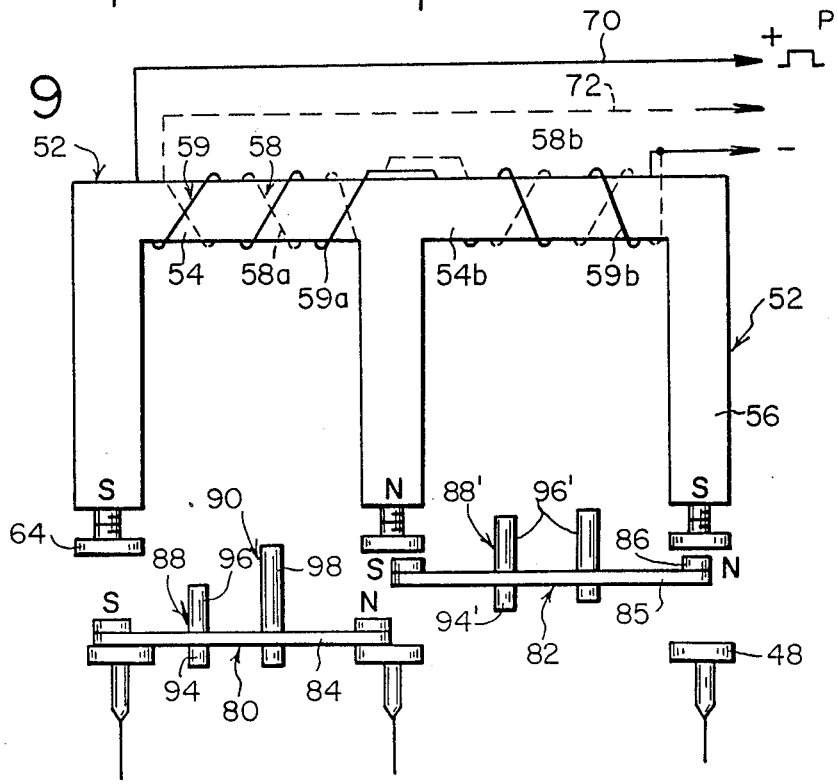

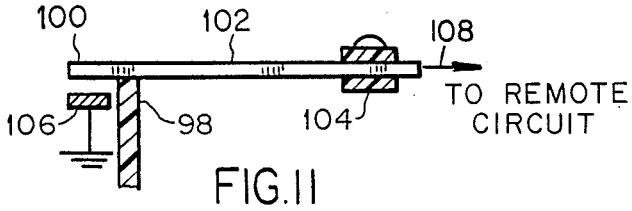
FIG.11
FIG. 10
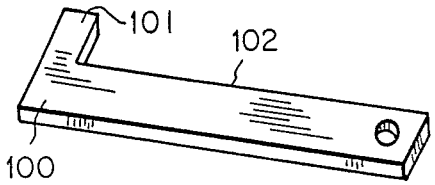
FIG. 12
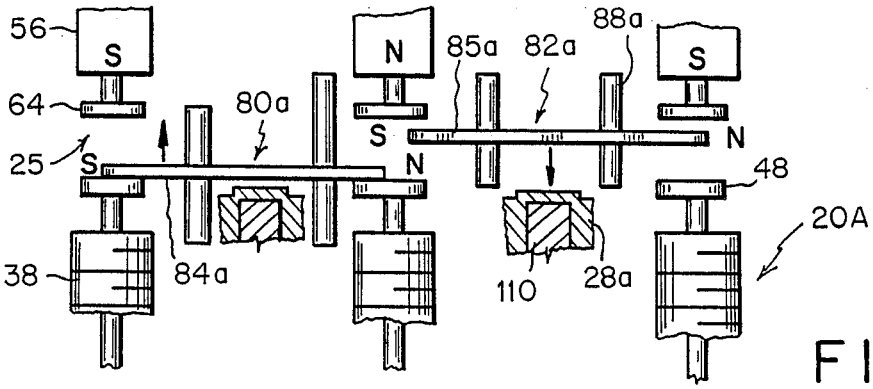
FIG. 13
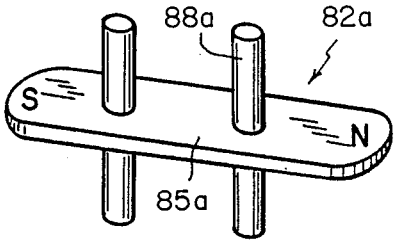
FIG. 14
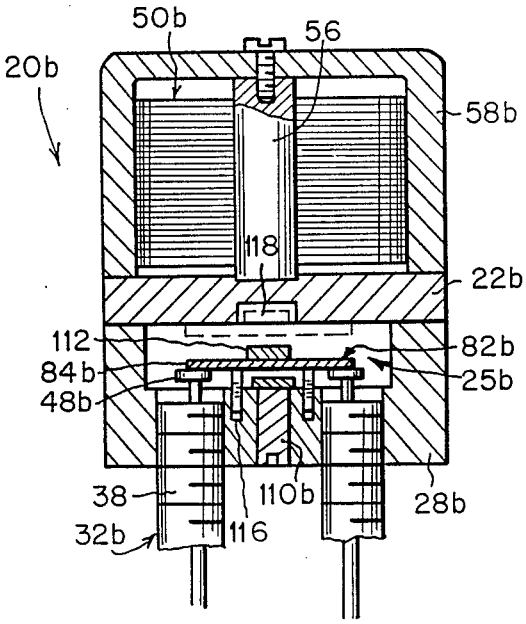
FIG. 16
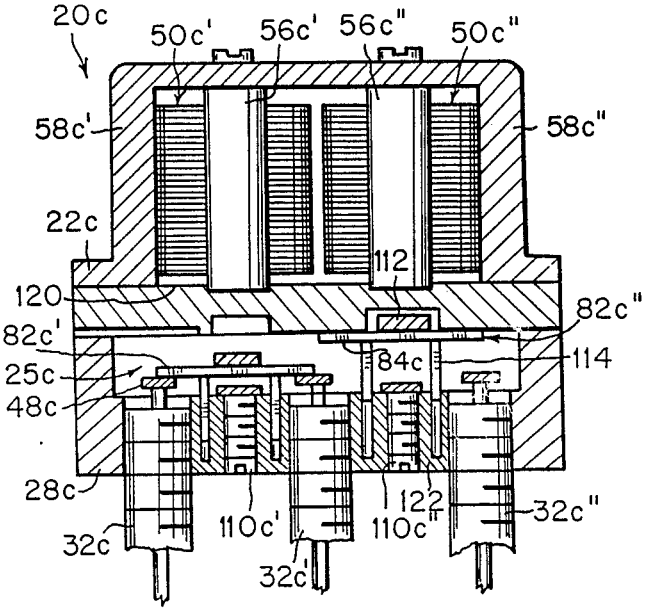

MAGNETIC SWITCH FOR COAXIAL TRANSMISSION LINES

BACKGROUND OF THE INVENTION

1. Field of the Invention

This invention relates to the art of switches used for coaxial radio frequency transmission lines, and more particularly concerns an improved magnetic switch for use with such transmission lines.

2. Description of the Prior Art

Heretofore switches used to control radio frequency and high frequency transmission between signal input and signal output coaxial lines, have employed spring actuated contacts, plungers, articulated joints, and other movable elements which are slow acting and not wholly reliable in operation. Some switches are not capable of automatically latching to remain in a set position; others are not capable of failsafe operation i.e. The contacts do not automatically return to a certain desired position if a circuit failure occurs. The prior switches, due to their complexity, introduce large impedances and insertion losses into the signal transmission lines, which is most objectionable. Besides being complex in construction, the prior switches are far to massive for applications requiring miniature switches, and they are very expensive to manufacture.

SUMMARY OF THE INVENTION

It is a principal object of the present invention to provide a fully magnetic switch which has fewer moving parts, which is smaller, lighter in weight, and simpler in construction than prior switches heretofore used for switching signals between coaxial lines. Another object of the present invention is to provide a magnetic switch assembly which can operate by latching when switched or which will revert automatically to failsafe position.

According to the invention there is provided a small, hollow body in which is a closed waveguide cavity. Two or more coaxial lines are connected to the body and have terminals exposed in the cavity. One or more conductive contact members in the cavity are movable magnetically from an open position spaced from pairs of line terminals to a closed position bridging one or more pairs of terminals. There the contact members remain latched until the contact members are switched again. In switches provided with failsafe facilties, the switched contact members remain or revert to closed position automatically when the opening magnetic forces are removed. An important feature of the invention is the simplified construction wherein the only moving parts of the switch in the cavity are the simple movable contact members. All other moving parts if any, are outside the cavity, so that insertion losses are minimized and potential operating difficulties due to internal mechanical complexity are avoided. The movable contact members are moved between open and closed positions by permanent magnets or by pulsed electromagnets adjacent the switching cavity containing the contact members. The contact members comprise magnetized strips, magnetic strips, or nonmagnetic strips carrying magnets or magnetic members. Some permanent magnets used to magnetically move the contact members can be arranged to rotate into and out of operating locations with respect to the contact members. Rotation of the magnets may be by an electric motor or a simple mechanical actuator of suitable type. The arrangement of the magnetic switch assembly is such that may be accomplished between two, three, four, or more coaxial transmission lines in single or multiple pole, single or multiple pole switching arrays.

In one specific magnetic switching assembly arranged for contact latching operation there is provided a small lightweight body having two abutting metal blocks or plates formed with recesses defining a closed waveguide which cannot support radio frequency transmission therein. In the cavity are two movable magnet switch contacts. The contacts are guided in movement by insulative guide pins slidably inserted in aligned bores in the two blocks. The total movement of the contacts is very small. Three coaxial lines to be switched in pairs have connectors carrying fixed contacts or terminals open to the cavity. The fixed contacts are alternately bridged or closed circuited and open circuited by the movable contacts. In operation, one movable contact at a time is grounded while the other conducts radio frequency input and output currents between two of the lines. On the metal body is an electromagnet having a magnetic, soft iron core provided with three legs terminating in magnetic poles disposed in the waveguide cavity. Wound on the core are two coils which are alternately pulsed electrically to reverse magnetic polarities of the poles. The movable contacts carry permanent magnets which are alternately attracted and repelled by the magnetic poles depending on their polarities. The repelled contact moves into close contact with an adjacent pair of fixed contacts while the attracted contact moves to the adjacent attracting magnetic poles. The assembly can thus serve as a single pole, double throw switch. A supplementary contact may be provided for opening and closing a remote telemetric circuit. This includes a springy normally grounded contact located outside the metal body and operated by movement of one of the guide pins on one of the movable magnetic contacts when it is attracted to its adjacent magnetic poles.

These and other objects and many of the attendant advantages of this invention will be readily appreciated as the same becomes better understood by reference to the following detailed description when considered in connection with the accompanying drawings in which:

BRIEF DESCRIPTION OF THE DRAWINGS

FIG. 7 is a sectional view similar to FIG. 6 of the other movable magnetic contact;

FIGS. 8 and 9 are two schematic diagrams of the electromagnet, showing the two movable magnetic contacts in two alternate operating positions with respect to adjacent pairs of fixed contacts;

FIG. 10 is an enlarged perspective view of a supplementary spring contact employed in the switch assembly for actuating a remote telemetric circuit;

FIG. 11 is a sectional view taken longitudinally through the spring contact of FIG. 10 which contact is shown in open position with respect to a grounding contact;

FIG. 12 is a diagram similar to portions of FIG. 9, showing parts of a second magnetic switch assembly embodying the invention;

FIG. 13 is an enlarged perspective view of a movable switch contact employed in the second magnetic switch assembly of FIG. 12;

FIG. 14 is a vertical sectional view of a third magnetic switch assembly embodying the invention;

FIG. 16 is a vertical sectional view of a fourth

DESCRIPTION OF THE PREFERRED EMBODIMENTS

Figure 1:
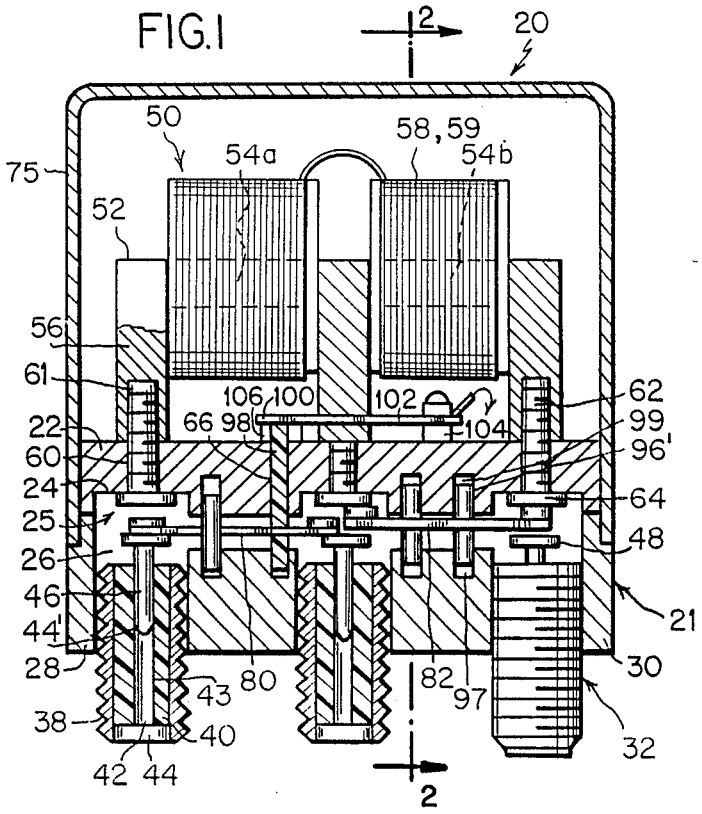
FIG. 1 is a vertical sectional view of a first magnetic switch assembly embodying the present invention.
Figure 2:
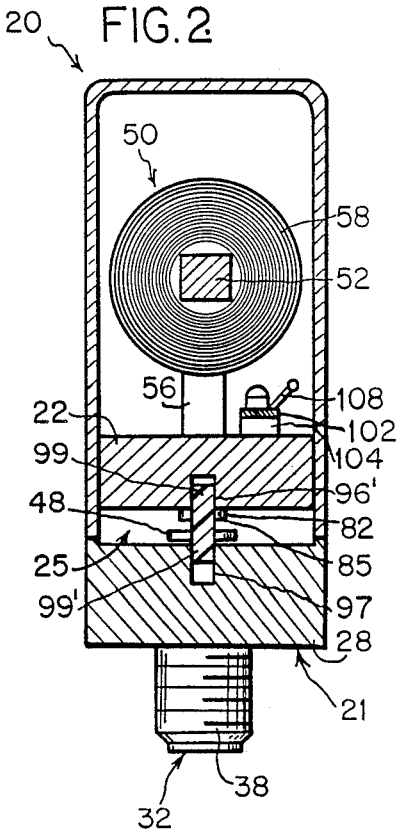
FIG. 2 is a vertical sectional view taken along line 2—2 of FIG. 1.
Figure 3:
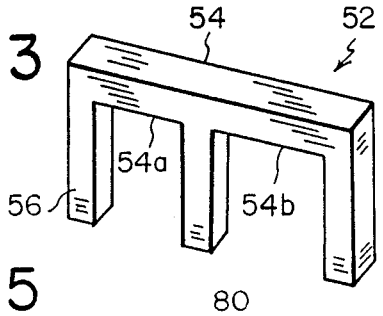
FIG. 3 is a perspective view of a core of an electromagnet which drives two movable magnetic contacts.

Referring now to the drawings wherein like reference characters designate like or corresponding parts throughout, there is illustrated in FIGS. 1 and 2, a first magnetic switch assembly designated generally by reference numeral 20 which comprises a body 21 having an upper metal block 22 in which is a recess 24 facing a recess 26 in a lower metal block 28 abutted to the upper block 22. The recesses 24, 26 define a closed waveguide cavity 25 which does not transmit radio frequency waves.

Figure 4:
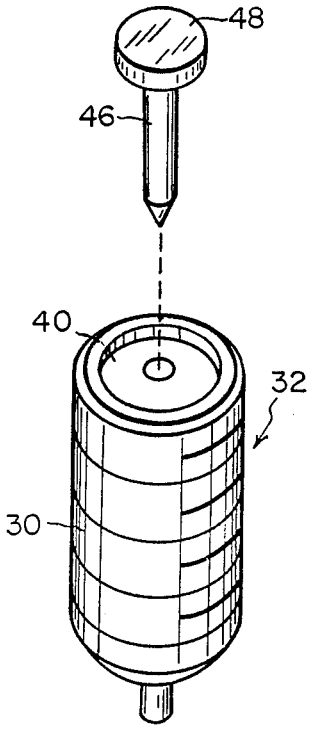
FIG. 4 is an enlarged exploded perspective view of parts of a coaxial connector and fixed terminal contact employed in the assembly of FIGS. 1 and 2.

In the lower block 28 are three threaded bores 30 in which are threaded three cylindrical coaxial line connectors 32 in laterally spaced, axially parallel array. Each of the connectors 32, as clearly shown in FIGS. 1 and 4, has an outer conductive metal shell 38 in which is an insulative liner 40. A central conductor core 42 extends through an axial bore 43 in each of the liners 40, and terminates in a socket 44. A post 46 extends axially from a soft iron disk 48 in each of the cores and is seated in socket 44 respectively; see FIG. 4. Each of the three disks 48 serves as a fixed switch contact and they are disposed inside of the cavity 25 in laterally aligned array.

Electromagnet 50 has a soft iron core 52 formed with a crossbar 54 having two sections 54*a*,54*b*. A core 52 has three depending legs 56 as best shown in FIGS. 1, 3, 8 and 9. A soft iron screw 61 is inserted through a hole 60 in the upper block 22 and is engaged in a threaded bore 62 in each of the legs 56. The soft iron heads 64 of each of the screws 58 abut the block 22, and serve as magnetic poles aligned with the fixed contacts 48. A bore 66 is provided in the block 22 for a purpose described below. The bore 66 extends from the cavity 25 to the upper side of the block 22 where the electromagnet 50 is mounted. On both crossbar sections 54*a*,54*b* of the core 52 are two coils or windings 58, 59, connected by leads 70, 72, 74 to an external pulsing circuit; see FIGS. 8 and 9. The coil 58 has two sections 58*a*,58*b* reversely wound on the respective crossbar 54*a*,54*b*. The coil sections 58*a*,58*b* are shown in solid lines in FIG. 8 and in dotted lines in FIG. 9. The coil 59 has two sections 59*a*, 59*b* reversely wound on the respective crossbar sections 54*a*,54*b*. The coil sections 59*a* and 59*b* are shown in dotted lines in FIG. 8 and in solid lines in FIG. 9. The direction of winding of the coil section 58*a* is opposite to that of the coil section 58*b* and the coil section 59*a*. The direction of winding of the coil section 59*b* is opposite to that of the coil section 58*b* and the coil section 59*a*. The opposite winding of the coil sections causes the three poles 56 to assume respectively N-S-N polarities as indicated in FIG. 8 when the winding 58 is energized by a pulse P′ applied to a pair of lead wires 72, 74 while the winding 59 is inactive. The poles 56 assume respective S-N-S polarities as indicated in FIG. 9 when the winding 59 is energized by a pulse P applied to the leads 70,74 while the winding 58 is inactive. An airtight cover 75 is mounted on the metal body 21 enclosing the electromagnet 50.

Figure 5:
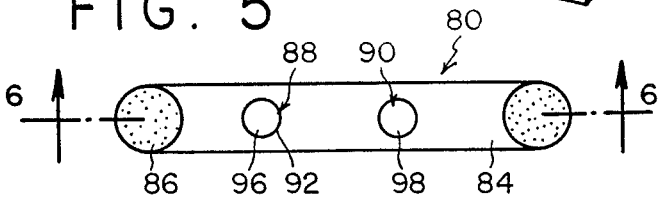
FIG. 5 is an enlarged top plan view of one of the two movable magnetic contacts.
Figure 6:
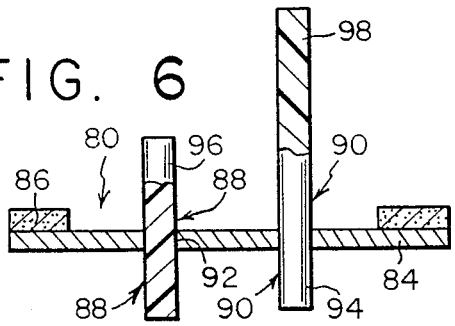
FIG. 6 is a longitudinal sectional view taken along line 6—6 of FIG. 5.

Inside the cavity 25 are two movable magnetic contacts 80, 82. As best shown in FIGS. 1, 5, & 9, each of the magnetic contacts 80,82 has a stiff electrically conductive metal base strip 84,85. At each end of the upper side of the strips 84 and 85 are circular disk-shaped permanent magnets 86. The contact 80 carries two spaced insulative, plastic guide pins 88, 90 extending through and secured in holes 92 in the strip 84. The pins 88, 90 have portions 94 of equal length extending below strip 84, and respective portions 96, 98 of unequal length above the strip 84. The pin portion 98 is longer than the pin portion 96. In the contact 82 are two identical insulative guide pins 88′ secured on the strip 85. Each pin portion 94′ is of equal length below the strip 85, and each longer pin portion 96′ is equal in length above the strip 85. The pin portions 94, 94′ are of equal length and the pin portions 96, 96′ are of equal length. The lower pin portions 94, 94′ are slidably engaged in respective spaced bores 97 in the lower block 28 (FIG. 1). The upper pin portions 96, 96′ are engaged in respective bores 99 in the upper block 22. The longest pin portion 98 is slidably engaged in the through bore 66 in the block 22.

When the contact 80 is magnetically moved upwardly to its adjacent pair of poles 64, the pin portion 98 moves up and contacts a lateral tab 101 of a spring contact 102; see FIGS. 10 and 11. Spring contact 102 is mounted at one end by an insulator 104 on the top of the block 22. The other end 100 of the spring contact 102 is free and contacts a fixed grounding member 106 on the block 22. The contact 102 is connected by a lead wire 108 to an external, remote telemetering circuit. Each time the switch contact 80 moves up it opens the contact 102 with respect to ground to actuate the remote telemetering circuit.

To cause the magnetic contacts 80 and 82 to move up and down alternately, the pulse P or P′ is applied to the leads 72, 74 or 70, 74, as indicated in FIGS. 8 and 9. When the pulse P is applied to the leads 70, 74 the winding 59 is energized as indicated in FIG. 9 to cause the contact 80 to move down while the contact 82 moves up. Since the magnets are polarized N and S at opposite ends, as indicated in FIGS. 8 and 9, the contact 80 is repelled by the adjacent N and S poles of the legs 56, while N and S magnets of the contact 82 are attracted by adjacent S and N poles of the legs 56. Similarly when a pulse P' is applied to the leads 72, 74 as indicated in FIG. 8, the magnetic polarities of the poles 64 are reversed and the magnetic contact 80 is attracted to the poles 64 and is held in the upper grounded position while the contact 82 is repelled and held in the lower bridging position at its adjacent fixed contacts 48 to close the radio frequency conducting circuits of the adjacent coaxial line connectors 32. The magnetization of the poles 64 is quite strong and much greater in magnitude than the magnetic force exerted by the magnets 86 so that the contacts 80 and 82 are moved directly to respective upper and lower positions and are held positively and securely until the polarities of the poles 64 are reversed. When each of the contacts 80 and 82 is in the upper position there is an open circuit between the pair of associated coaxial connectors and lines because the cavity 25 acts as a nonconducting waveguide for radio frequency transmission. Thus the bridged pair of coaxial lines conduct radio frequency current while the open pair of coaxial lines do not. The input-output pairs of coaxial lines are thus alternately switched to conductive and nonconductive conditions.

In a typical magnetic switch assembly intended to operate with radio frequency currents in the range of 0 (DC) to 18,000 MHZ, about ten watts can be safely switched. A switch,such as switch 20, will require movement of the switch contacts 80 and 82 of about 0.05 inches. The movable contacts 80,82 can be made of gold plated phosphor bronze strips, about 150 of an inch wide about 0.02 inches thick and about 0.5 inches long. The guide pins 88, 88', 90 may be made of polytetrafluorethylene (teflon). The permanent magnets 86 can be about 150 of an inch in diameter and about 0.02 inches thick Soft iron contacts 48 can also be gold plated which insures stability under all operating conditions, and long useful life. The blocks 22, 28 can be made of lightweight aluminum.

Overall the entire switch assembly 20 may be about 0.6 inches wide, 1.5 inches long, and 1.5 inches in height. It will thus be apparent that the entire switch assembly 20 is very small, compact, light in weight, and simple in construction with a minimum of moving parts. The switching contacts for the coaxial lines avoid the use of prior plungers and pivoted spring loaded moving elements. Although the switch assembly is very small in size, it is very rugged and will retain its switching effectiveness under prolonged adverse ambient conditions.

The magnetic switch assembly 20 of FIGS. 1-11 is basically of the latching type, i.e. the switch contacts 80,82 maintain their last set position when no power is applied to the windings 58,59 of the electromagnet 50. It may be desirable in some applications to have the contacts 80 and 82 retract to a failsafe position when no power is applied to the windings 58,59 or when the magnetic holding power of the poles 56 weakens. This may be accomplished as indicated by the arrangement of a second magnetic switch assembly 20A shown in FIG. 12 where the parts corresponding to those of the switch the assembly 20 are identically numbered.

The switch contacts 80*a* and 82*a* each have a contact strip 84*a* or 85*a* carrying guide pins 88*a*. The strips 84*a*, 85*a* are made of permanently magnetized material so that each strip 84*a* 85*a* is a bar magnet; see FIG. 13. Below each strip embedded in the block 28*a* are two cylindrical permanent magnets 110 respectively centered under each of the strips 84*a*,85*a* but outside of the cavity 25*a*. Normally the switch assembly 20A operates in the same manner as described for the switch assembly 20 as described above. However, if the magnetic fields maintained at the poles 56,64 weaken, then the magnet 110 will retract the elevated magnetic or magnetized switch contact 80*a* or 82*a* from the open circuit position, to hold it in the failsafe, closed circuit position bridging the two adjacent line adjacent line terminal disks 48.

FIG. 14 shows a single-pole, single throw, third magnetic switch assembly 20B having a closed failsafe position, in which the switch contact 82*b* bridges the line terminal disks 48*b* of the two coaxial lines 32*b* when the winding 58*b* on the core 56*b* of the electromagnet 50*b* is deenergized. The switch contact 82*b* has a movable contact strip 84*b* which is made of electrically conductive material and which need not be magnetic or magnetized. On the top of the strip 84*b* is a magnetic disk 112 secured at the center of the strip 84*b*; see FIG. 15. The strip 84*b* carries a pair of depending insulative pins 114 which slide in respective aligned bore holes 116 in the lower block 28*b*. A closed r.f. cavity 25*b* is defined between the lower block 28*b* and the upper block 22*b*. In the bottom of the block 22*b* is a cavity 118 into which a magnetic disk 112 can project when the electromagnet 50*b* is energized so that the magnetized core or pole 56*b* attracts the disk 112 and the strip 84*b* to elevate the switch contact 82*b*. In the lowered position of the switch contact 82*b*, the strip 84*b* bridges the terminal disks 48*b* as shown in FIG. 14. This is the closed failsafe position. At this time, the permanent magnet 110*b* which is embedded in the block 28*b* is the active magnet which holds the switch contact 82*b* in the failsafe bridging position. When the electromagnet 50*b* is deenergized the switch contact 82*b* remains in the lowered, failsafe closed circuit position. When the electromagnet 50*b* is energized, then the magnetic field generated by the soft iron pole 56*b* overrides the weaker magnetic field maintained by the permanent magnet 110*b* to elevate the switch contact 82*b* to the open circuit switch position. As long as the pole 56*b* remains sufficiently magnetized, the switch remains in the open circuit position. When the magnetic field weakens, then the switch closes to the failsafe closed circuit position as the magnet 110*b* draws the switch contact 82*b* down to bridge the two line terminals 48*b*.

Figure 15:
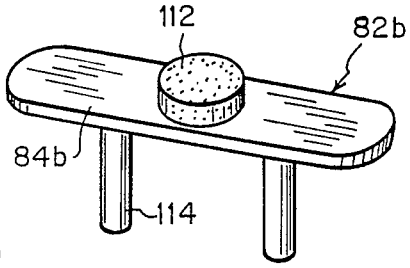
FIG. 15 is an enlarged perspective view of a movable switch contact employed in the third magnetic switch assembly of FIG. 14.

FIG. 16 shows a single-pole, double-throw fourth magnetic switch assemble 20C arranged for failsafe operation, in a manner similar to that shown in FIGS. 14 and 15 and described above. The assembly 20C has two electromagnets 50*c*' and 50*c*'' with individual cylindrical poles or cores 56*c*' and 56*c*'' axially disposed within windings or coils 58*c*' and 58*c*''. The poles 56*c*'',56'' terminate in recesses 120 on top of a block or plate 22*c* which closes a cavity 25*c* in a lower block or plate 28*c*. In the bottom of cavity 25*c* are three line terminal disks 48*c* at the upper ends of three coaxial lines 32*c*,32*c*',32*c*''. Two contacts 82*c*',82*c*'' like the contact 82*b* shown in FIG. 15 are reciprocatable up and down in the cavity 25*c* guided by the depending pins 114. In the assembly 20C the two switch contacts 82*c*' and 82c'' are each provided with a contact strip 84c and a centered magnetic disk 112 Axially aligned with each of the disks 112 is a cylindrical permanent magnet 110c' or 110c'' each disposed in an axial bore 122 in the block 28c so that the magnets 110c',110c'' are outside of the cavity 25c. The poles 56c' and 56c'' also terminate outside of the cavity 25c. One of the contact strips 84c normally bridges the coaxial lines 32c.32c' in the failsafe closed circuit position. When either one or both of the electromagnets 50c',50c'' are energized, either one or both of the contact strips 84c are attracted upwardly to the grounding block 22c because the magnetic fields of the poles 56c',56c'' override the weaker magnetic force exerted by the magnets 110',110c''. When the energizing current of either one of the electromagnets 50c',50c'' or both, is off or fails, or weakens or cuts off the magnetic fields to the poles 56c',56c'', then the switch contacts 82c',82c'' are drawn down to the failsafe position bridging the line pairs 32c,32c'and/or 32c', 32c''. By alternately energizing the electromagnets 50c, and 50c'', the contacts 82c' and 82c'' are alternately attracted upwardly to open circuit the line pairs 32c,32c' and 32c',32c'' so that the switch assembly acts as a single-pole, double-throw switch. It should be noted at this point that the previously described magnetic switch assemblies 20 and 20A also act as single-pole, double-throw switches, with two alternate open and closed line positions, as contrasted with the switch assembly 20B which acts as a single-pole, single-throw switch with only one open position and one closed position for the two lines 32b.

FIGS. 17 through 21B show a fifth magnetic switch assembly 20D embodying modifications of the invention and adapted for double-pole, double-throw operation. This switch assembly has a sector motor 125 provided with a stationary coil 126 enclosed in a cylindrical shell 128 and supported by a cylindrical housing 130 carried by a stationary base block or plate 132. The motor 125 is arranged to turn 90° in one direction or the other each time it is pulsed by an externally applied voltage. The rotary axial armature 134 has a central shaft 136 which carries a plate 138 which rotates with the shaft 136 and the armature 134. In each of a pair of recesses 140 spaced apart 180° is a permanent magnet disk 142a, or 142b. The disks 142a, 142b rotate adjacent to a stationary electrically conductive grounding plate 144 which closes the cavity 25d in the block 132.

Figure 17:
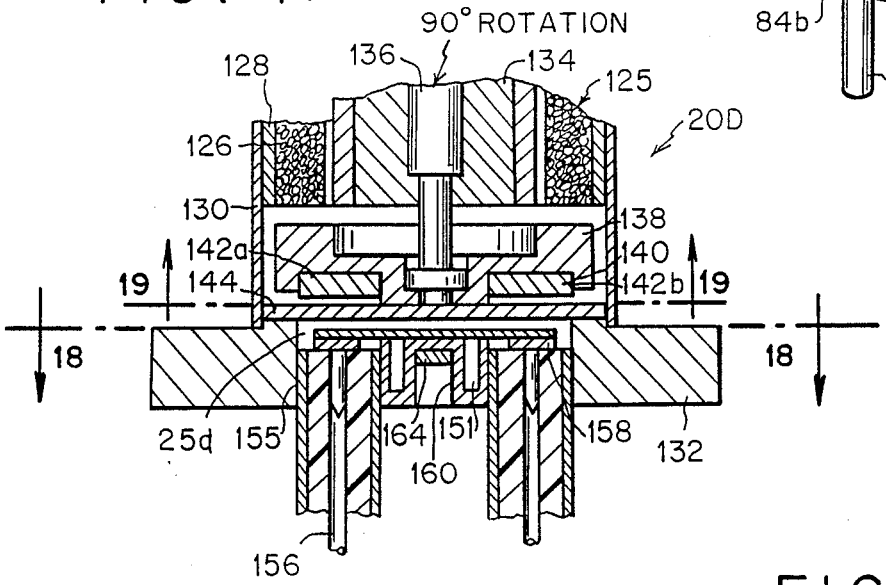
FIG. 17 is a fragmentary vertical sectional view of a fifth magnetic switch assembly e the invention.
Figure 18:
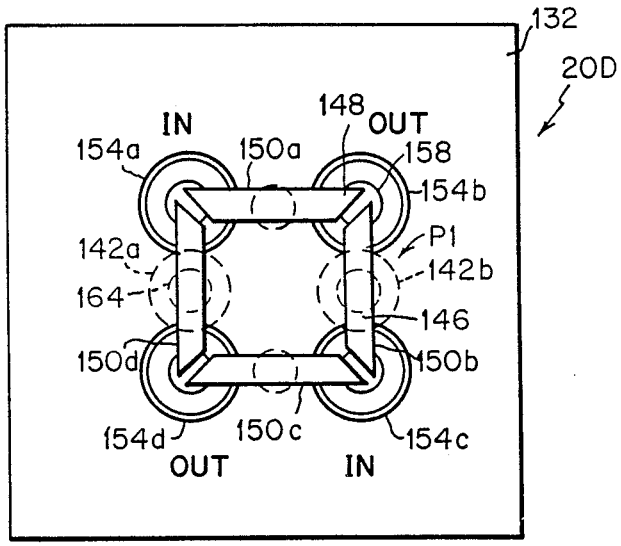
FIG. 18 and FIG. 19 are horizontal sectional views taken along lines 18—18 and 19—19 respectively, of FIG. 17.
Figure 19:
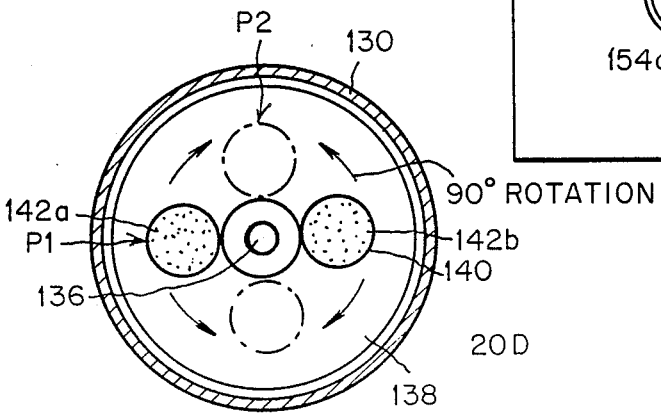
Figure 20:
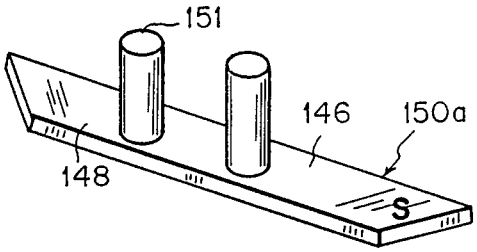
FIG. 20 is an enlarged perspective view of a magnetic switch contact employed in the fifth switch assembly of FIGS. 17–19.

Four magnetic switch contacts 150a,150b,150c, and 150d are disposed in a rectangular array below the grounding plate 144 in the cavity 25d. Each of the four contacts are selectively reciprocatable upward to an open circuit grounding position when one of the magnets 142a or 142b is centrally disposed above the contact 150. Each of the contacts 150, as best shown in FIGS. 17,18, and 20, comprises a flat contact strip 146 terminating in acute angled ends 148. Two guide pins 151 extend downwardly from the bottom side of the strip 146 and are slidably disposed in bores of the block or plate 132.

Four coaxial lines 154a–154d are secured in a respective bore 155 in the block 132. A central conductor 156 of each of the coaxial lines 154a–154d terminates in an electrically conductive disk or head 158. Four bores 160 are formed in the block 132 with each receiving a permanent magnet 164. The magnets 164 are centered below the four contact strips 146 of the switch contacts 150a–150d. The magnets 164 are located outside of the cavity 25d as are the magnets 142a,142b.

Figure 21A:
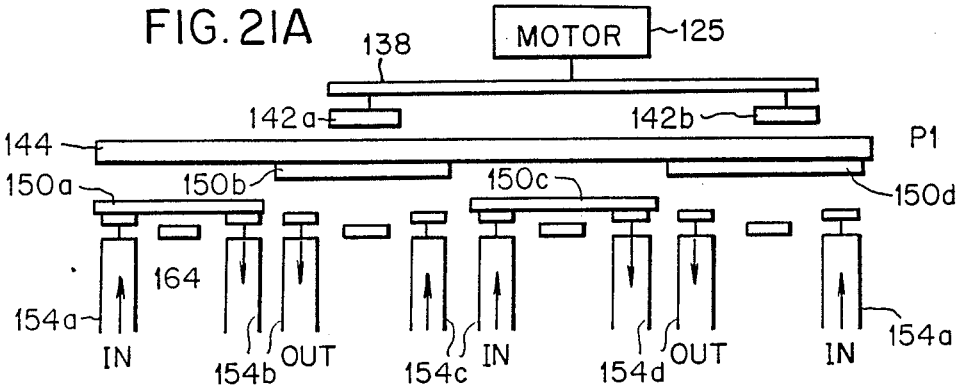
FIG. 21A and 21B are diagrams illustrating two operating positions of the fifth magnetic switch assembly of FIGS. 17–19.
Figure 21B:
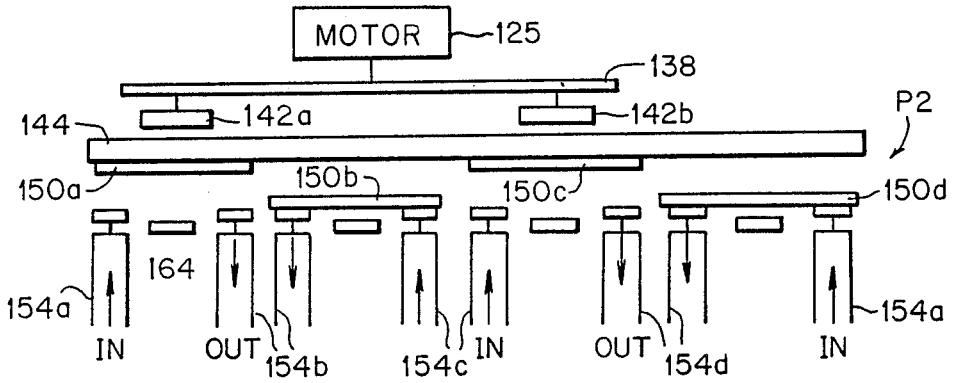

In operation of the magnetic switch assembly 20D, let us suppose that the coaxial lines 154a and 154c are signal input lines, and that the lines 154b and 154d are signal output lines as indicated in FIG. 18, and in FIGS. 21A and 21B. The switch assembly may have alternately two switch positions Pl or P2. In position Pl as indicated diagrammatically in FIG. 21A, the magnets 142a and 142b are rotated to center over the contacts 150b and 150d. The magnets 142a and 142b attract contacts 150b and 150d to the ground plate 144, The contacts 150a and 150c are held down by the magnets 164 and bridge the coaxial lines 154a, 154b, and 154c, 154d respectively. Thus signals coming in on the line 154a go out on the line 154b, and signals coming in on the line 154c go out on the line 154d. The paths 154c to 154b and 154a to 154d are open circuited. The bridging contacts 154a and 154c are in the failsafe closed circuit bridging position as shown in FIG. 21A.

The switch reverses when the motor 125 turns the magnets 142a,142b by 90° via the plate 138 to the position P2 shown in FIG. 21B. Then the contact 150b bridges the lines 154b,154c and the contact 150d bridges the lines 154a,154d, while the contacts 150a and 150c open circuit the lines 154a,154b, and 154c,154d. Thus the switch assembly 20D acts as a double-pole, double-throw switch. If the magnets 142a,142b should stall in a position other than the P1 and P2 positions shown in the drawings, or if the magnets 142a,142b should weaken, then all four of the switch contacts 150a–150d would descend automatically to closed circuit or a failsafe bridging position, to be held there by magnets 164.

Figure 22:
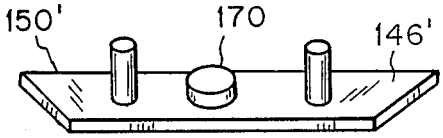
FIG. 22 is an enlarged perspective view of another magnetic switch contact usable in the fifth magnetic switch assembly, in place of the switch contact of FIG. 20.

In order for switch assembly 20D to operate as described, the contact strips 146 must be made of magnetic material, for example soft iron, which can be magnetized, so that the contacts can be attracted alternately by the magnets 142a,142b and 164. At the same time these contact strips must have good conductivity to conduct currents between the IN and OUT coaxial lines. In order to separate the two functions, the contacts can be constructed as shown in FIG. 22, where the contact 150' has a contact strip 146' made of a highly conductive material which is nonmagnetic, such as copper, silver, gold plated metal of any kind, etc. In order to attract the contact alternately between the magnets 164 and 142a,142b, small magnetic disk or magnet 170 can be centrally mounted on the strip 146'. This construction is similar to that of the contacts 80 and 82 of the switch assembly 20 where the magnets 86 are mounted on the contact strip 84 which need not be magnetic but should have good conductivity to pass currents between the magnetized line terminals 48. The magnets 86 coact with the magnetized terminals 48. The contact strips 85a of the contacts 80a and 82a used in the switch assembly 20A are magnetized as shown in FIG. 13, to coact with the magnetized line terminals 48 and to perform the electrical conducting function. When the contact strip carries the centered magnets or magnetic elements as shown in FIGS. 15 and 22 the contact strips need not be made of magnetic material and the contact terminals 48b and 48c and 158 need not be magnetized. Thus there are available the options of employing contact strips which are nonmagnetic, magnetic,or magnetized with or without auxiliary magnets, but in all cases the contact strips must have high electrical conductivity with low insertion loss.

Figure 23:
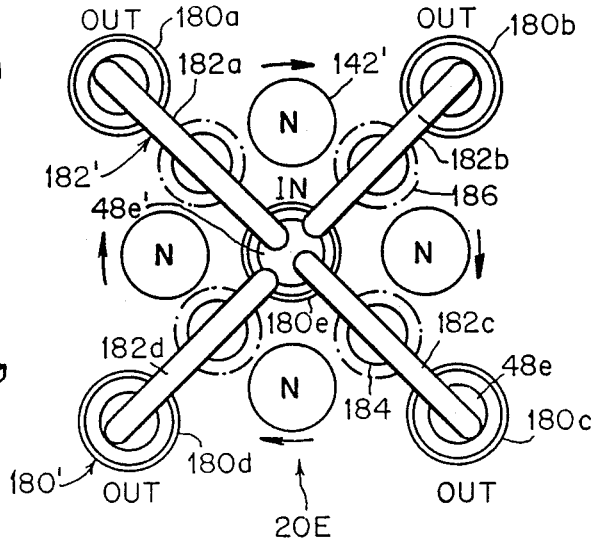
FIG. 23 is a horizontal sectional view, similar to FIG. 18, and partially diagrammatic in form, showing parts of a sixth magnetic switch assembly embodying the invention.

In FIG. 23 is shown diagrammatically a sixth magnetic switch assembly 20E which can operate as a single-pole, quadruple-throw, triple-throw, double-throw, or single-throw switch. This switch assembly has four coaxial lines at corners of a rectangular array similar to the arrangement of switch assembly 20D shown in FIGS. 17 and 18. Here all the coaxial lines 180*a*,180*b*,180*c*,and 180*d* are designated as signal output lines terminating in nonmagnetic terminals 48*e*. There are four thin, flat, movable contacts 182*a*–182*d* arranged in a cruciform array. At their inner ends each contact strip 183 can contact the terminal disk 48*e*′ of the central coaxial line 180*e*. Each of the contact strips 183 carries a centrally located magnetic disk 184 which is attracted to a lower permanent magnet 186. A motor or mechanical actuator (not shown) carries four upper magnets 142′ disposed 90° apart. In the position shown in FIG. 23, all of the contacts 182*a*–182*d* are in the failsafe closed circuit position bridging the input terminal 48*e* to the terminals of the output lines 180*a*–180*d* respectively. When the magnets 142′ are rotated 45° then the four magnets will be centered over all the contact strips 183 and will retract them upward away from the line terminal disks 48*e*,48*e*′ to open circuit position. Thus, in a single turn of 45° by the rotor of the magnets all input-output connections can be opened and in a subsequent turn of 45° all input-output line connections can closed by the magnets 186. In an alternate construction the magnets 142′ can be replaced by four individual electromagnets like those shown in FIGS. 14 and 16. These electromagnets will have poles permanently positioned over the centers of the four contact strips 183. Then as each of the electromagnets is energized, its magnetized pole will attract upwardly the associated contact 182*a*–182*d* and when the electromagnet is deenergized, the attracted contact will be released under the attractive force of the associated magnet 186. In this way, all four of the switch contacts 182*a*–182*d* could operate independently of each other depending on which electromagnet is energized or deenergized. All of the contact members will revert to the closed circuit failsafe bridging position show in FIG. 23 when the electromagnets are deenergized.

If desired more than five coaxial lines 180′ can be connected to switching assembly 20E. An additional switching contact member 182′ will be provided for each additional line to bridge the added line and the central line 180*e*. It is also possible to employ the central line 180*e* as the signal output line and all the other lines 180*a*–180*d* can be signal input lines. Similarly in all the other switching assemblies described above, the functions of the signal input lines and output lines can be reversed.

From the foregoing it will be apparent that two basic types of magnetic switching assemblies have been described. There is the latching type as exemplified by the switch assembly 20 of FIG. 1 where the movable switch contact remains in the last set position when the associated electromagnet is deenergized; and the failsafe type of switch assemblies 20B–20E where the switch contacts always return to failsafe line bridging position when the actuating magnetic field weakens or is turned off.

If desired it is possible to turn or position the space actuating magnets 142*a*,142*b* and 142′ of switch assemblies 20D and 20E by some mechanical actuator means other than an electrically driven motor, without changing the basic mode of operation of the magnetic switch assembly.

The sealed cavities 25,25*a*–25*d* can be used as relay cavities to switch other electrical signals than microwave and radio frequency signals.

In practical embodiments of the magnetic switch assemblies, the several magnets can be made in miniature sizes or rare earth materials. When the contact strips are made of soft iron, they can be gold plated to increase their conductivity and provide low insertion loss. The several magnetic switch assemblies are adapted for miniature construction. The contact strips of the movable conacts can be about 0.019 inches thick, and their total up or down travel can be about 0.09 inches.

The switch assemblies have cavities 25*a*–25*d* which are fully sealed to avoid spurious ambient effects. The small magnets 110,110*b*,110*c*′,110*c*″, 164, 186 beneath the movable contacts are strong enough to insure positive, secure electrical contact with the terminals of the coaxial lines. The motor or mechanical actuator which turns or positions the upper magnets for opening the input-output line connections is very lightly loaded since it only has to turn the magnets in a plane. The line connection closing force is exerted by the magnets under the movable switch contracts.

It should be understood that the foregoing relates to only a preferred embodiment of the invention which has been by way of example only and that it is intended to cover all changes and modifications of the example of the invention herein chosen for the purpose of the disclosure, which do not constitute departures from the spirit and scope of the invention.

What is claimed is:

1. A magnetic switch for coaxial transmission lines, comprising:

a hollow body having spaced walls defining a closed cavity with laterally spaced bores in one of said walls;

first and second coaxial transmission lines engaged in said bores and having laterally spaced conductive first and second line terminals in said cavity;

an electrically conductive first contact member reciprocatable in said cavity between a closed circuit first position bridging said first and second line terminals, and open circuit second position spaced from said line terminals;

guide means in said cavity restraining said contact member to reciprocate between said first and second positions;

first magnet means supported by said body and arranged to move said contact member magnetically from said closed circuit first position to said open circuit second position;

second magnet means supported by said body and arranged to move said contact member magnetically from said open circuit second position to said closed circuit first position an electromagnet having a magnetizable core and a winding on said core, said first magnet means comprising a first coil section of said winding, said electromagnet being effective to move said contact member magnetically from said closed circuit first position to said open circuit second position when said coil section is energized;

said second magnet means comprising a second coil section of said winding, said electromagnet being effective to move said contact member magnetically from said open circuit second position to said closed circuit first position when said second coil section is energized while said first coil section is deenergized; and said contact member comprising a contact strip made of non-magnetic material, and at least one permanent magnet on said strip disposed or alternate attraction and repulsion by said electromagnet when said first and second coil sections are alternately energized.

2. A magnetic switch as claimed in claim 1, further comprising a third magnet means disposed adjacent said contact member for holding the same in said closed circuit second position when said first and second coil sections are deenergized.

3. A magnetic switch for coaxial transmission lines, comprising:

a hollow body having spaced walls defining a closed cavity with laterally spaced bores in one of said walls;

first and second coaxial transmission lines engaged in said bores and having laterally spaced conductive first and second line terminals in said cavity;

an electrically conductive first contact member reciprocatable in said cavity between a closed circuit first position bridging said first and second line terminals, and open circuit second position spaced from said line terminals;

guide means in said cavity restraining said contact member to reciprocate between said first and second positions;

first magnet means supported by said body and arranged to move said contact member magnetically from said closed circuit first position to said open circuit second position;

second magnet means supported by said body and arranged to move said contact member magnetically from said open circuit second position to said closed circuit first position;

an electromagnet having a magnetizable core and a winding on said core, said first magnet means comprising a first coil section of said winding, said electromagnet being effective to move said contact member magnetically from said closed circuit first position to said open circuit second position when said coil section is energized;

said second magnet means comprising a second coil section of said winding, said electromagnet being effective to move said contact member magnetically from said open circuit second position to said closed circuit first position when said second coil section is energized while said first coil section si deenergized; and wherein said contact member comprises a contact strip made of magnetized material for alternate attraction and repulsion by said electromagnet when said first and second coil sections are alternately energized.

4. A magnetic switch as claimed in claim 3 further comprising third magnet means disposed adjacent said contact member for holding the same in said closed circuit second position when said first and second coil sections are deenergized.

5. A magnetic switch as claimed in claim 1, further comprises a first permanent magnet disposed adjacent to said contact member and effective to move the same magnetically to said closed circuit first position from said open circuit second position, and to hold said contact member in said closed circuit first position when said first coil section is deenergized.

6. A magnetic switch assembly for coaxial transmission lines, comprising:

a hollow body having spaced walls defining a closed cavity with laterally spaced bores in one of said walls;

first and second coaxial transmission lines engaged in said bores and having laterally spaced conductive first and second line terminals in said cavity;

an electrically conductive first contact member reciprocatable in said cavity between a closed circuit first position bridging said first and second line terminals, and open circuit second position spaced rom said line terminals;

guide mans in said cavity restraining said contact member to reciprocate between said first and second positions;

first magnet means supported by said body and arranged to move said contact member magnetically from said closed circuit first position to said open circuit second position;

second magnet means supported by said body and arranged to move said contact member magnetically from said open circuit second position to said closed circuit first position;

wherein said first magnetic means comprises a first permanent magnet disposed to attract and move said contact member magnetically to said open circuit second position.

7. A magnetic switch assembly as claimed in claim 6 wherein said second magnet means comprises a second permanent magnet disposed adjacent said contact member to attract and move said contact member magnetically to said closed circuit second position and to hold said contact member at said closed circuit second position.

8. A magnetic switch assembly as claimed in claim 7, wherein said contact member comprises a magnetic contact strip adapted for alternate magnetic attraction and movement by said first and said second permanent magnets.

9. A magnetic switch assembly as claimed in claim 7, wherein said contact member comprises a nonmagnetic strip, and a magnetic member on said strip disposed for alternate magnetic attraction and movement by said first and said second permanent magnets 10. A magnetic switch as claimed in claim 1, a third coaxial transmission line engaged in another one of said bores and having a third line terminal laterally spaced from said second line terminal in said cavity;

an electrically conductive second contact member reciprocatable in said cavity between a closed circuit third position bridging said second and said third line terminals, and an open circuit fourth position spaced from said second and third line terminals;

further guide means in said cavity restraining said second contact member to reciprocate between said third and said fourth positions;

third magnet means supported by said body and arranged to move said second contact member magnetically from said closed circuit third position to said open circuit fourth position; and fourth magnet means supported by said body and arranged to move said second contact member magnetically from said open circuit fourth position to said closed circuit third position.

11. A magnetic switch as claimed in claim 10, said third magnet means comprising a second coil section of said winding, said electromagnet being effective to move said second contact member magnetically from said closed circuit third position to said open circuit fourth position when said second coil section is energized.

12. A magnetic switch as claimed in claim 10, further comprising a second electromagnet having a magnetizable second core and a second winding on said second core, said second electromagnet being effective to move said second contact member magnetically from said closed circuit third position to said open circuit fourth position when said second winding is energized.

13. A magnetic switch as claimed in claim 11, wherein said second magnetic means comprises a third coil section of said winding, said electromagnet being effective to move said first contact member magnetically from said open circuit second position to said closed circuit first position when said third coil section is energized while said first coil section is deenergized; and wherein said second magnetic means further comprises a fourth coil section of said winding, said electromagnet being effective to move said second contact member magnetically from said open circuit fourth position to said closed circuit third position when said fourth coil section is energized while said third coil section is deenergized.

14. A magnetic switch as claimed in claim, 12, wherein said second magnetic means comprises a first permanent magnet disposed adjacent to said first contact member and effective to move the same magnetically to said closed circuit first position from said open circuit second position and to hold said first contact member in said closed circuit first position when said first winding is deenergized; and wherein said second magnetic means further comprises a second permanent magnet disposed adjacent to said second contact member and effective to move the same magnetically to said closed circuit third position from said open circuit fourth position and to hold said second contact member in said closed circuit third position when said second winding is deenergized.

15. A magnetic switch assembly for coaxial transmission lines comprising: a hollow body having spaced inner walls defining a closed cavity, with laterally spaced bores in one of said walls;

first, second, third and fourth contact members reciprocatable in said cavity between a closed circuit first position respectively bridging two adjacent ones of said terminals and an open circuit position spaced from said terminals;

guide means in said cavity restraining said contact members to reciprocate between said first and said second positions; and first magnet means disposable in one location with respect to said contact members and arranged to move said first and third contact members magnetically from said closed circuit first position to said open circuit second position, while said second and fourth contact members remain in said closed circuit first position, said first magnet means being disposable in another location spaced from said one location and arranged to move said second and fourth contact members magnetically from said closed circuit first position to said open circuit second position, while said first and third contact members remain in said closed circuit first position.

16. A magnetic switch assembly as claimed in claim 15, further comprising second magnet means disposed adjacent each of said contact members and arranged to restore said first and third contact members to said closed circuit first position when said first magnet means moves to said second location, and to restore said second and fourth contact members to said closed circuit first position when said first magnet means moves to said first location.

17. A magnetic switch assembly as claimed in claim 16, further comprising means for rotating said first magnet means alternately to said first and second locations.

18. A magnetic switch assembly as claimed in claim 17, wherein each, of said magnet means are permanent magnets.

19. A magnetic switch for coaxial transmission lines, comprising a body having spaced walls defining a closed waveguide cavity therebetween, one of said walls having laterally spaced, axially parallel bores therein;

first, second and third coaxial connectors for three coaxial transmission lines disposed in said bores respectively and having conductive cores terminating in first, second and third laterally spaced fixed contact members in said cavity;

an electromagnetic actuator on said body having laterally spaced first, second and third fixed magnetic poles disposed in said cavity in alignment with and spaced from said fixed contact members respectively;

first and second movable contact members in said cavity, each having two spaced, fixed permanent magnets respectively disposed adjacent two of said three poles, said magnets having opposite N and S magnetic polarities, said first movable contact member being disposed adjacent said first and second poles, said second movable contact member being disposed adjacent said second and third poles;

insulative guide means for each movable contact member restraining said movable contact members to move laterally between said poles and said fixed contact members; and a coil winding on said electromagnetic actuator arranged to polarize said first and second magnetic poles with magnetic polarities respectively corresponding to said N and S polarities of said magnets for repelling said first movable contact member into direct contact with said first and second fixed contact members for electrically bridging said conductive cores of said first and second coaxial connectors, and for holding said first movable contact member stationary thereat, said coil winding being further arranged to polarize said third magnetic pole with such polarity, that said second movable contact member is attracted toward said second and third magnetic poles and is held stationary thereat, so that said cores of said second and third coaxial connectors are held open circuited; and another coil winding on said electromagnetic actuator arranged to polarize said magnetic poles with such magnetic polarities that said first movable contact member is attracted to said first and second poles and away from said first and second fixed contact members to open circuit said first and second coaxial connectors, and so that said second movable contact member is repelled from said second and third poles to said second and third fixed contact members to bridge said cores of said second and third coaxial connectors and close circuit the same, whereby alternate electric energization of said windings causes said first and second transmission lines to be closed circuited while said second and third transmission lines are open circuited, and vice versa.

* * * * *